US007500826B2

(12) United States Patent
Tseng et al.

(10) Patent No.: US 7,500,826 B2
(45) Date of Patent: Mar. 10, 2009

(54) CENTRIFUGAL FAN

(75) Inventors: Chun-Fa Tseng, Kaohsiung (TW); Yu-Nien Huang, Chung Li (TW)

(73) Assignee: Quanta Computer, Inc., Tao Yuan Shien (TW)

( * ) Notice: Subject to any disclaimer, the term of this patent is extended or adjusted under 35 U.S.C. 154(b) by 321 days.

(21) Appl. No.: 11/476,098

(22) Filed: Jun. 28, 2006

(65) Prior Publication Data

US 2007/0248458 A1 Oct. 25, 2007

(30) Foreign Application Priority Data

Apr. 24, 2006 (TW) ..... 95114591 A

(51) Int. Cl.
*F04D 29/30* (2006.01)

(52) U.S. Cl. ..... 415/206; 415/208.2; 415/211.2

(58) Field of Classification Search ..... 415/208.2, 415/224, 220; 416/247 R
See application file for complete search history.

(56) References Cited

U.S. PATENT DOCUMENTS

2005/0058543 A1* 3/2005 Takeshita et al. ..... 415/206

FOREIGN PATENT DOCUMENTS

DE 3612249 A1 * 10/1987

* cited by examiner

*Primary Examiner*—Richard Edgar
(74) *Attorney, Agent, or Firm*—Rabin & Berdo, P.C.

(57) ABSTRACT

A centrifugal fan includes a spiral-shaped housing with a driving mechanism and multiple internally mounted centrifugal impellers. The driving mechanism is mounted on a circular base. At least two support brackets links the circular base to the spiral-shaped housing, wherein profiles of the support brackets are involute curves based upon the circular base. The multiple centrifugal impellers, driven by the driving mechanism, suck airflow into the spiral-shaped housing through void spaces among the support brackets. The centrifugal impellers are perpendicular to the support bracket profiles.

4 Claims, 2 Drawing Sheets

CENTRIFUGAL FAN

RELATED APPLICATIONS

The present application is based on, and claims priority from, Taiwan Application Serial Number 95114591, filed on Apr. 24, 2006, the disclosure of which is hereby incorporated by reference herein in its entirety.

BACKGROUND

1. Field of Invention

The present invention relates to a centrifugal fan. More particularly, the present invention relates to a centrifugal fan with a noise reduction functionality.

2. Description of Related Art

As notebook PCs become thinner, less space is available for heat convection and heat dissipation components inside the notebook PC case housing. High-frequency components, such as the CPU (central processing unit) and graphics processing chip, also place limitations on heat dissipation designs. Thus, the mainstream method to dissipate heat is forced heat convection via a centrifugal fan.

A centrifugal fan employs a spiral-shaped flow channel design to convert dynamic air energy into static pressure so as to overcome the high air flow impedance inside the notebook PC case housing. However, high static pressure generating centrifugal fans face the dual challenge of reducing noise and improving heat dissipation efficiency. Noise can be divided into broadband noise and narrowband noise, wherein narrowband noise is preferably eliminated from a centrifugal fan.

FIG. 1 illustrates a perspective view of a conventional centrifugal fan. A centrifugal fan 100 includes a spiral-shaped housing 102, which has a motor (not illustrated) and an internal centrifugal impeller 108. The motor is mounted behind the base 106, and three support brackets 104 links the base 106 to the remaining parts of the spiral-shaped housing 102. Three void spaces are formed between the three support brackets 104, the base 106 and the remaining parts of the spiral-shaped housing 102. When the motor rotates the centrifugal impeller 108, driven airflow is sucked along a direction 110 and then into the spiral-shaped flow channel through the void spaces. The driven airflow, which travels at a rate of 15-40 km/hr with relation to the spiral-shaped housing 102, is unavoidably incident into the support bracket 104. Crashing impacts against the support bracket 104, which perpendicularly links to the base 106 and the spiral-shaped housing 102, generates high-frequency, narrowband noise.

SUMMARY

It is therefore an objective of the present invention to provide a centrifugal fan with noise reduction functionality.

In accordance with the foregoing and other objectives of the present invention, a centrifugal fan includes a spiral-shaped housing with a driving mechanism and multiple internally mounted centrifugal impellers. The driving mechanism is mounted on a circular base. At least two support brackets link the circular base to the spiral-shaped housing, support bracket profiles are involute curves based on the circular base. The multiple centrifugal impellers, driven by the driving mechanism, suck airflow into the spiral-shaped housing through void spaces among the support brackets. The centrifugal impellers are perpendicular to the support bracket profiles.

Thus, the centrifugal fan support bracket profiles of the present invention are made of involute curves and are perpendicular to centrifugal impeller of the centrifugal fan, thereby reducing crashing impacts caused by airflow sucked into the centrifugal fan and against the support bracket profiles, and minimizing high-frequency narrow-band noise.

It is to be understood that both the foregoing general description and the following detailed description are by examples, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

DESCRIPTION OF THE PREFERRED EMBODIMENTS

Figure 1:
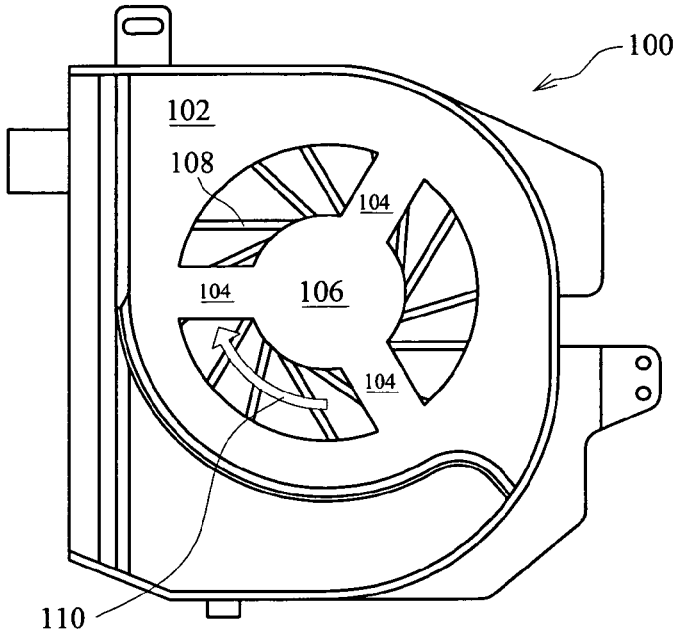
Fig. 1 (PRIOR ART)
FIG. 1 illustrates a perspective view of a conventional centrifugal fan.

Reference will now be made in detail to the present preferred embodiments of the invention, examples of which are illustrated in the accompanying drawings. Wherever possible, the same reference numbers are used in the drawings and the description to refer to the same or like parts.

Figure 2:
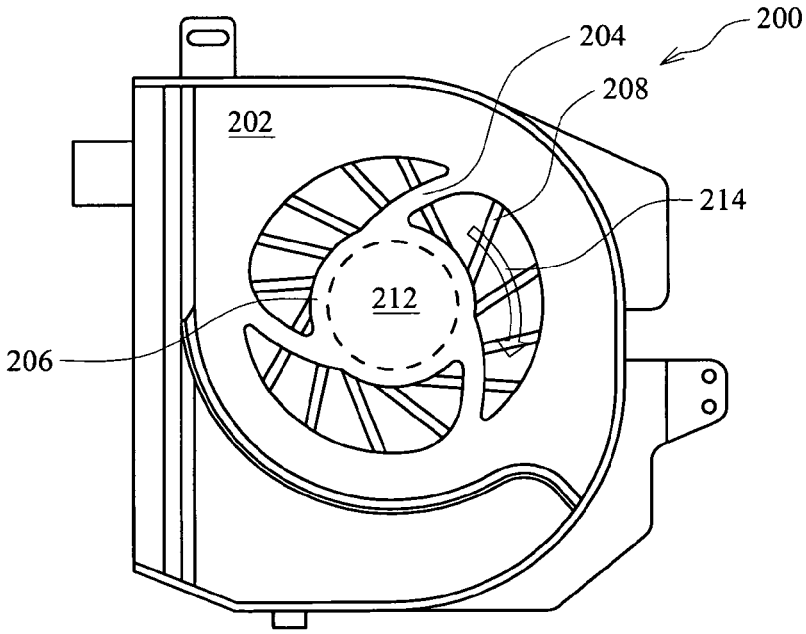
FIG. 2 illustrates a perspective view of a centrifugal fan according to one preferred embodiment of this invention.

FIG. 2 illustrates a perspective view of a centrifugal fan according to one preferred embodiment of this invention. A spiral-shaped housing 202 of a centrifugal fan 200 has a driving mechanism 212 (such as a motor) and centrifugal internally mounted impellers 208. The driving mechanism 212 (dashed line) is mounted behind a base 206, and three support brackets 204 links the base 206 to the remaining portions of the spiral-shaped housing 202. Three void spaces are formed between the three support brackets 204, the base 206 and the remaining portions of the spiral-shaped housing 202. Support bracket 204 profiles are involute curves based on the circular base 206. The involute curves extend from the circular base 206 towards the rotational direction 214 of the centrifugal impellers 208. The support brackets 204, which have their involute curve profiles, can reduce the crashing impacts against thereof, thereby decreasing high-frequency, narrow-band noise.

Figure 3:
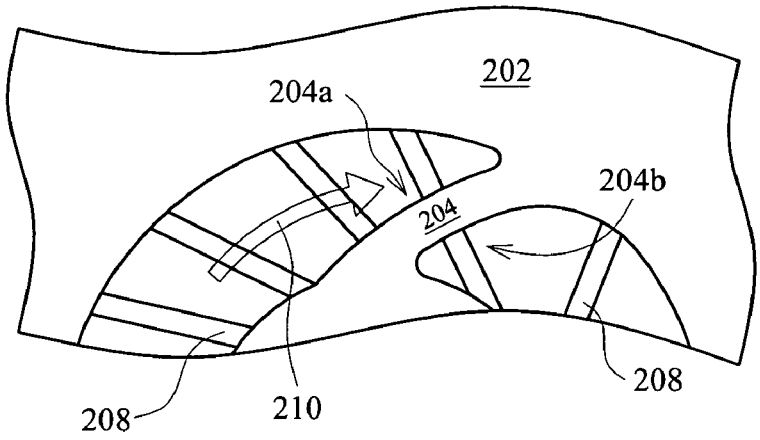
FIG. 3 illustrates an enlarged view of part of a spiral-shaped housing according to one preferred embodiment of this invention.

FIG. 3 illustrates an enlarged view of part of the spiral-shaped housing in FIG. 2 according to one preferred embodiment of this invention. When the motor rotates the centrifugal impellers 208, driven airflow is sucked in the rotational direction 210 and then through the void spaces into the spiral-shaped flow channel. In this preferred embodiment, the support bracket 204 profiles 204*a* and 204*b* are involute curves based on the circular base 206 (as illustrated in FIG. 2), thereby reducing the crashing impacts against the support brackets 204. The centrifugal impellers 208 are designed with an acute angle between its leeward side and a hub of the centrifugal impellers 208. In this preferred embodiment, the centrifugal impellers 208 are specifically adjusted to be perpendicular to the support bracket 204 profiles 204*a* and 204*b* such that the crashing impacts against the support brackets

204 are minimized. Due to involute curve characteristics, part of the profiles 204*a* and 204*b* are perpendicular to the centrifugal impellers 208, remaining parts of the profiles 204*a* and 204*b* are thus perpendicular to the centrifugal impellers 208. Also due to involute curve characteristics, the driven airflow, which travels at a rate of 15-40 km/hr relative to the spiral-shaped housing 202, can be sucked into the spiral-shaped flow channel with minimal impact against the support brackets 204.

Figure 4:
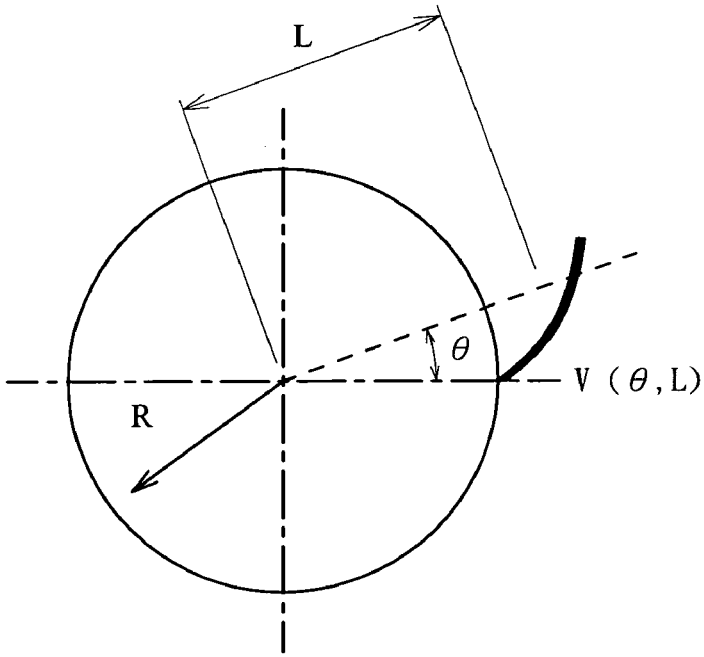
FIG. 4 illustrates an involute curve according to one preferred embodiment of this invention.

FIG. 4 illustrates an involute curve according to one preferred embodiment of this invention. The profiles 204*a* and 204*b* in FIGS. 2 and 3 are formed according to the involute curve equation $V=Le^{i\theta}$, wherein:

$$L=R(1+t^2)^{0.5};$$

$$\theta=t-\tan^{-1}(t);$$

V is an involute curve;

L is a distance between a point of the involute curve and a center of the circular base;

R is radius of the circular base;

T is a parameter from zero to infinity; and

θ is an angle between an initial line and a line, which links the point of the involute curve and the center of the circular base.

According to preferred embodiments of the present invention, the experimental results of BPF (Blade Passing Frequency) noise can be reduced by up to 10 db.

According to preferred embodiments, the centrifugal fan of the present invention has its support bracket profiles formed of involute curves and its support bracket profiles are perpendicular to its centrifugal impeller, thereby reducing crashing impacts, caused by airflow sucked into the centrifugal fan and against the support bracket profiles, as well as minimizing high-frequency and narrow-band noise thereof.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A centrifugal fan, comprising:

a housing;

a circular base;

a driving mechanism, mounted on the circular base;

at least two support brackets, linking the circular base to the housing, the support bracket profiles are involute curves based upon the circular base; and multiple centrifugal impellers, driven by the driving mechanism and sucking airflow into the housing through void spaces among the support brackets, wherein the involute curves are generated according to the equation $V=Le^{i\theta}$, wherein:

$$L=R(1+t^2)^{0.5};$$

$$\theta=t-\tan^{-1}(t);$$

V being an involute curve;

L being the distance between a point of the involute curve and a center of the circular base;

R being the radius of the circular base;

T being a parameter from zero to infinity; and

θ being an angle between an initial line and a line, linking the point of the involute curve and the center of the circular base.

2. The centrifugal fan of claim 1, wherein the driving mechanism is a motor.

3. A centrifugal fan, comprising:

a housing;

a circular base;

a driving mechanism, mounted on the circular base;

at least two support brackets, linking the circular base to the housing, the support bracket profiles are involute curves based upon the circular base; and multiple centrifugal impellers are driven by the driving mechanism and suck airflow into the housing through void spaces among the support brackets, the centrifugal impellers are perpendicular to the support bracket profiles, wherein the involute curves are generated according to the equation $V=Le^{i\theta}$, wherein:

$$L=R(1+t^2)^{0.5};$$

$$\theta=t-\tan^{-1}(t);$$

V being an involute curve;

L being the distance between a point of the involute curve and a center of the circular base;

R being the radius of the circular base;

T being a parameter from zero to infinity; and

θ being an angle between an initial line and a line, linking the point of the involute curve and the center of the circular base.

4. The centrifugal fan of claim 3, wherein the driving mechanism is a motor.

* * * * *